US010071273B2

(12) United States Patent
Hansen et al.

(10) Patent No.: US 10,071,273 B2
(45) Date of Patent: Sep. 11, 2018

(54) NEWTONIAN FOAM SUPERCONCENTRATE

(71) Applicants: Steve Hansen, Marinette, WI (US); Lucas M. L. Jacobs, Lichtaart (BE)

(72) Inventors: Steve Hansen, Marinette, WI (US); Lucas M. L. Jacobs, Lichtaart (BE)

(73) Assignee: McWane Luxembourg IP S.a.r.l., Luxembourg (LU)

( * ) Notice: Subject to any disclaimer, the term of this patent is extended or adjusted under 35 U.S.C. 154(b) by 114 days.

(21) Appl. No.: 14/907,780

(22) PCT Filed: Jul. 28, 2014

(86) PCT No.: PCT/US2014/048489

§ 371 (c)(1),
(2) Date: Jan. 26, 2016

(87) PCT Pub. No.: WO2015/013717

PCT Pub. Date: Jan. 29, 2015

(65) Prior Publication Data

US 2016/0166867 A1 Jun. 16, 2016

Related U.S. Application Data

(60) Provisional application No. 61/859,021, filed on Jul. 26, 2013.

(51) Int. Cl.

| | |
|---|---|
| ***A62C 2/00*** | (2006.01) |
| ***A62D 1/02*** | (2006.01) |
| ***A62C 5/02*** | (2006.01) |
| ***A62C 35/02*** | (2006.01) |
| ***A62C 3/00*** | (2006.01) |
| *A62C 99/00* | (2010.01) |

(52) U.S. Cl.

CPC ..... *A62D 1/0071* (2013.01); *A62C 3/00* (2013.01); *A62C 5/02* (2013.01); *A62C 35/023* (2013.01); *A62C 99/0009* (2013.01); *A62C 99/009* (2013.01); *A62C 99/0018* (2013.01)

(58) Field of Classification Search

CPC ..... A62D 1/0071; A62C 99/0009; A62C 99/009; A62C 99/0018; A62C 3/00; A62C 35/023; A62C 5/02

USPC ..... 169/9, 11, 14, 16, 43, 46, 47; 252/3, 252/8.05

See application file for complete search history.

(56) References Cited

U.S. PATENT DOCUMENTS

| | | | | |
|---|---|---|---|---|
| 7,569,155 B2 * | 8/2009 | Schaefer | ..... | A62D 1/0071 252/3 |
| 2008/0196908 A1 * | 8/2008 | Schaefer | ..... | A62D 1/0071 169/46 |

* cited by examiner

*Primary Examiner* — Steven J Ganey
(74) *Attorney, Agent, or Firm* — C. Brandon Browning; Maynard, Cooper & Gale, PC

(57) ABSTRACT

The invention provides an aqueous foaming Newtonian concentrate, an expanded foam composition and a process of forming a foam composition concentrate. The aqueous foaming concentrate includes a carbonized saccharide mixture, a surfactant, water and optionally further agents including cross-linking agents, thickeners, solvents, stabilizers, buffers, corrosion inhibitors and preservatives. Foaming concentrates of the present invention are free of fluorine and persistent organic pollutants and particularly suited for use in fire prevention, suppression and extinguishment, vapor suppression and wetting of surfaces at concentrations less than 1.3% by weight.

39 Claims, 8 Drawing Sheets

NEWTONIAN FOAM SUPERCONCENTRATE

FIELD OF INVENTION

The present invention relates to an aqueous foaming concentrate, an expanded foam composition and a process of forming a foam composition. In particular the present invention relates to Newtonian foam concentrates and aqueous foam compositions prepared therefrom containing less than or equal to 1.3% by volume of the concentrates. Foaming compositions of the present invention are most preferably substantially or totally bio-degradable and/or environmentally compatible.

BACKGROUND OF THE INVENTION

Foam materials are a class of commercially and industrially important chemical-based materials. Foams can be prepared by aerating a foaming composition (i.e., entrapping air in a foaming composition), which can be derived by diluting a concentrated precursor. Many foams require certain physical properties to be appropriately useful in desired applications. Among preferred physical properties for foams is the property of stability, to allow the foam to be in a useful form over an extended period of time and therefore useful where an especially stable foam can be desirable, e.g., fire prevention, fire extinguishment, vapor suppression and freeze protection for crops. Further uses include the reduction of surface tension for desirable penetration of fuels and wetting of surfaces, eg. fire extinguishment, surface cleaning/decontamination and surface preparation (such as for concrete surfaces).

An important class of commercial foams includes aqueous film-forming foams (e.g., AFFFs and FFFPs), which aqueous compositions typically contain fluorochemical surfactants, non-fluorinated (e.g., hydrocarbon) surfactants, and aqueous or non-aqueous solvents. These foams can be prepared from concentrates by diluting with water (fresh, brackish or sea water) to form a "premix," and then aerating the premix to form a foam.

Foaming compositions are often conveniently manufactured as a concentrate, to save space and reduce transportation and storage costs. The dilution prior to use of the concentrate is typically 3% concentration by volume (that is, 3 volumes of foam concentrate per 97 volumes of water). Other typical concentrations include 6% concentration by volume.

The foam can be dispersed onto a liquid chemical fire to form a thick foam blanket that knocks down the fire and then extinguishes the fire by suffocation. These foams also find utility as vapor suppressing foams that can be applied to non-burning but volatile liquids, e.g., volatile liquid or solid chemicals and chemical spills, to prevent evolution of toxic, noxious, flammable, or otherwise dangerous vapors. These foams can also be used on structural and bush or forest fires.

Individual components of a foaming composition contribute toward different physical and chemical properties of the premix and the foam. Selective surfactants can provide low surface tension, high foamability, and good film-forming properties, i.e., the ability of drainage from the foam to spread out and form a film over the surface of another liquid. Organic solvents can be included to promote solubility of surfactants, to promote shelf life of the concentrate, and to stabilize the aqueous foam. Thickening agents can be used to increase viscosity and stability of the foam. Other agents and additives can be used as is known to those skilled in the art.

Especially preferred properties of foams are stability, vapor suppression, and burnback resistance. Stability refers to the ability of a foam to maintain over time its physical state as a useful foam. Some fire-fighting foams, e.g., foams prepared from foaming premix compositions containing surfactant and hydrated thickener, are stable for periods of hours, or at least up to an hour, and are often regularly reapplied. Longer periods of stability can be achieved by adding ingredients such as reactive prepolymers and cross-linkers, polyvalent ionic complexing agents and proteins.

The use of fluorochemical compounds in foaming compositions for firefighting is wide spread for example as taught in U.S. Pat. Nos. 3,772,195; 4,472,286; 4,717,744; 4,983,769; 5,086,786 and 5,824,238. The fluorinated compounds are generally used as surfactants to reduce the surface tension of the foaming composition. However, the production and use of certain fluorochemicals is being reduced and/or phased-out due to concerns associated with such chemicals and/or their use.

Natural compounds such as protein and polysaccharide additives to fire fighting foam solutions are also known. In particular, polysaccharides have been utilised in many forms including cellulose and its derivatives, guar gum, xanthan gum, and polysaccharide derivatives including molasses and other extractions including formoses, in addition to disaccharides and monosaccharides. The use of these materials in fire fighting foams are disclosed for example in U.S. Pat. No. 2,514,310 (1946), JP 53023196 (1978), DE 2937333-A (1981), GB 2179043-A (1986), U.S. Pat. No. 4,978,460 (1988) and U.S. Pat. No. 5,215,786 (1993).

U.S. Pat. No. 2,514,310 describes a composition suitable for production of fire extinguishing foams containing an aqueous solution of an N-acyl, N-alkyl taurine sodium salt and a carboxymethylcellulose sodium salt. The compositions of the invention produce fire extinguishing foams highly effective for extinguishing liquid fires.

JP 53023196 describes the use of carboxymethylated yeast-based protein fire extinguishing solutions. The solutions are especially useful for treating large scale fires; the foams having good heat and oil resisting properties.

DE 2937333-A describes a water composition for extinguishing fires which contains a fire-retardant additive and optionally a wetting or foaming agent, preservative, phosphates, nitrogen compounds and further additives. The fire-retardant additive for use in the invention is a polysaccharide or compounds of this type which include molasses and/or formoses (being formaldehyde polymers).

GB 2179043-A describes aqueous foams primarily for use in the food industry as meringues and cake mixes. The foams are formed when compositions containing one acidic foamable protein, preferably whey protein isolate or bovine serum albumin, and a cationic polysaccharide, preferably chitisan. The aqueous foam composition can additionally contain a soluble sugar such as sucrose.

U.S. Pat. No. 4,978,460 is directed to additives for water for the use in firefighting compositions containing strongly swelling water-insoluble high molecular weight polymers as a gelatinising agent. The improvement to which the specification is directed relates to the use of release agents to encase and disburse the gelatinising agents protecting them from becoming sticky upon the penetration of water and dust from agglutinating. The preferred release agents of the invention are polyalkylene glycols. Further compounds including diammonium phosphates and sugars such as sugar alcohols including mannitol are described as being suitable for use as the release agent.

U.S. Pat. No. 5,215,786 describes compositions for forming a biodegradable foam barrier between a substrate and the atmosphere. The foam-forming composition includes sodium sulphonate, a long alkyl chain carboxylic acid, potassium hydroxide, potassium silicate, a non-ionic solid organic water soluble material such as a sucrose or urea, and a hydroxylic solvent.

U.S. Pat. No. 4,060,489 describes an aqueous foam formed with solution containing thixotropic polysaccharide in addition to foaming agent, such that it will gel when projected onto a burning liquid fires. The thixotropic character enables the ready pumping of the foam and of the solution from which it is formed. The concentrate contains a substantial amount of N-methylpyrrolidone-2 for such foam-producing solution so as to make the concentrate more adaptable for ready dilution and also improves its stability. Urea can be added to help solubilise the polysaccharide and to reduce the viscosity of the concentrate.

CN 1231207 describes the use of the proteosome of sugar beet plant in the preparation of a firefighting foam.

U.S. Pat. No. 4,387,032 describes fire-fighting foam concentrates containing thixotropic polysaccharide thickeners dissolved in water. Higher concentrations are made practical by including in the concentrate urea, thiourea, ammonium cyanate or ammonium thiocyanate, to reduce the concentrate's viscosity and keep the polysaccharide from separating out upon freezing.

U.S. Pat. No. 5,215,786 describes foam concentrates containing sodium sulfate, a carboxylic acid, potassium hydroxide, potassium silicate, a non-ionic solid organic water-soluble material and a hydroxylic solvent. Optionally the concentrate may contain sucrose or urea to assist in foam stiffness by increasing the solids content.

WO 03/049813 describes foam forming concentrates comprising a carbonised saccharide composition, a surfactant and water. These compositions enhance the performance of the foam for fire suppression and control, and related applications whilst exhibiting good biodegradability and environmental compatibility. The foam finds particular use in suppressing and extinguishing non-polar fires.

Despite the number of foaming compositions known, the continual threat of fire to property, structures, goods and the bush and the destruction, devastation and loss of life it causes means that there is an ongoing need for new, improved or at least alternative aqueous foaming compositions, foam compositions, and methods of preparing foaming compositions. There also is a particular need for preparing foam compositions that are substantially or totally biodegradable and/or environmentally compatible. There is also a need for foaming compositions that can stored in a more concentrated form to allow for easier transport and storage, e.g., concentrates that are diluted prior to use at less than 3% concentration by volume.

SUMMARY OF THE INVENTION

Is has surprisingly been found by the present inventors that the use of a carbonised saccharide composition with a decrease concentration of polysaccharides in fire-fighting foams greatly enhances the viscosity of the foam. In particular, the low viscosity of the foam concentrates of the present invention products provide easier handling of pumping and transport of the concentrate, especially during the winter time and rapid dilution and thereby accurate proportioning of the concentrate. Since the viscosity is sufficiently low, i.e., to be considered as nearly a Newtonian system, the foam concentrates of the present invention can be directly added to the water (known as a "direct dumping" method in the firefighting industry) without the use of an eductor. It has also been found that the low viscosity of the foam concentrates of the present invention provides improved storage capabilities, i.e., the concentrate is diluted prior to use at 1.3% or less concentration by volume (that is, 1.3 volumes or less of foam concentrate per 98.7 volumes or more of water). The improved viscosity and storage qualities of the concentrates are provided in the absence of fluorine containing compounds such as organofluorines or other persistent organic pollutants.

Thus according to a first aspect of the present invention there is provided a foam forming composition comprising: a carbonised saccharide composition, a cross linker, a surfactant, and water.

According to a second aspect of the present invention there is provided a foam composition prepared from the foam forming composition of the first aspect.

According to a third aspect of the present invention there is provided a process for preparing a foam composition including the step of aerating a foam forming composition comprising a carbonised saccharide composition, a cross linker, a surfactant, and water. The foam forming composition is preferably aerated by adding the foam forming composition to a flow of water, preferably water flowing through a hose and nozzle such as a fire-fighting hose.

According to a fourth aspect of the present invention there is provided a process for preparing a foam forming composition including mixing a carbonised saccharide composition, a cross linker, a surfactant and water in any suitable order to form the composition.

According to a fifth aspect of the present invention there is provided a method for enhancing the fire fighting capabilities of a foam including the step of preparing a foam forming composition containing a carbonised saccharide composition with decrease polysaccharide concentration for use in the preparation of the foam.

According to a fifth aspect of the invention there is provided a method of making a fire extinguishing foam solution including providing a fluorine-free concentrate including a sugar that has been subjected to a carbonization step during its manufacture and one or more surfactants, wherein the concentrate is free of fluorine, and forming a foam forming solution by diluting the concentrate with water, wherein the foam forming solution contains less than 1.3% by volume of the concentrate. The concentrate may include one or more polysaccharides are present in the concentrate at an amount equal to or less than 0.1% by weight and exhibit a viscosity of 100 cSt or less.

According to sixth aspect of the invention there is provided a fire extinguishing foam solution including a concentrate including a sugar that has been subjected to a carbonization step during its manufacture, water and one or more surfactants, wherein the concentrate is a Newtonian fluid that is free of fluorine and persistent organic pollutants. The concentrate includes between 10% by weight and 35% by weight of the water, 6% to 17% by weight of the sugar and about 19% by weight of the one or more surfactants. The concentrate may further include a total polysaccharide content of 0.1% by weight or less. The concentrate may be diluted with water such as sea water to provide a mix including 1.3% by volume or less of the concentrate and 98.7% by volume or more water. The concentrate includes 15% to 20.0% by weight of total active surfactant, 4.5% to 7.0% by weight of amphoteric surfactant, 7.0% to 11.0% by weight of anionic surfactant, 1.0% to 4.0% by weight of nonionic surfactant, 0% to 2.0% by weight of a stabilizer, 6.0% to 20.0% by weight of salt, and 0% to 15.0% by weight of solvent.

According to a seventh aspect of the invention there is provided a method of extinguishing a fire including providing a Newtonian concentrate including a sugar that has been subjected to a carbonization step during its manufacture, and one or more surfactants, wherein the concentrate is free of fluorine, mixing the concentrate with an amount of water to provide a solution including 1.3% or less by volume of the concentrate, aerating the solution to produce a foam, and applying the foam to a fire. The concentrate The concentrate meets or exceeds European Standard EN 1568-3 for low expansion fire extinguishing foam concentrates Underwriters Laboratories standard for safety for foam equipment and liquid concentrates UL 162.

The foam concentrates of the present invention produce environmentally sustainable fluorosurfactant and fluoropolymer-free firefighting foams designed to effectively extinguish Class B fuels such as hydrocarbon and polar solvent fuel fires with no environmental concerns for persistence, bioaccumulation or toxic breakdown. The foam concentrates can be used in fresh, salt or brackish water and possess improved burn back resistance due to their flow and rapid sealing characteristics. The foam concentrates can be used to prevent re-ignition of liquid spills, control hazardous odors and improve extinguishment in deep-seated fires. Foam non-air aspirating discharge devices as well as air aspirating discharge devices including standard sprinkler heads can be used to obtain maximum results. The concentrates can also be used as a pre-mix solution. The foam concentrates can be proportioned at the proper foam solution percentage using common foam proportioning devices such as eductors, inline balanced pressure proportioners, ratio controllers, and self-educting nozzles. The foam concentrates of the present invention are meant to replace current aqueous film forming foams and an alcohol-resistant aqueous film forming foams.

Throughout this specification and the claims which follow, unless the context requires otherwise, the word "comprise", and variations such as "comprises" or "comprising", will be understood to imply the inclusion of a stated integer or step or group of integers or steps but not the exclusion of any other integer or step or group of integers or steps.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION

Figure 1:
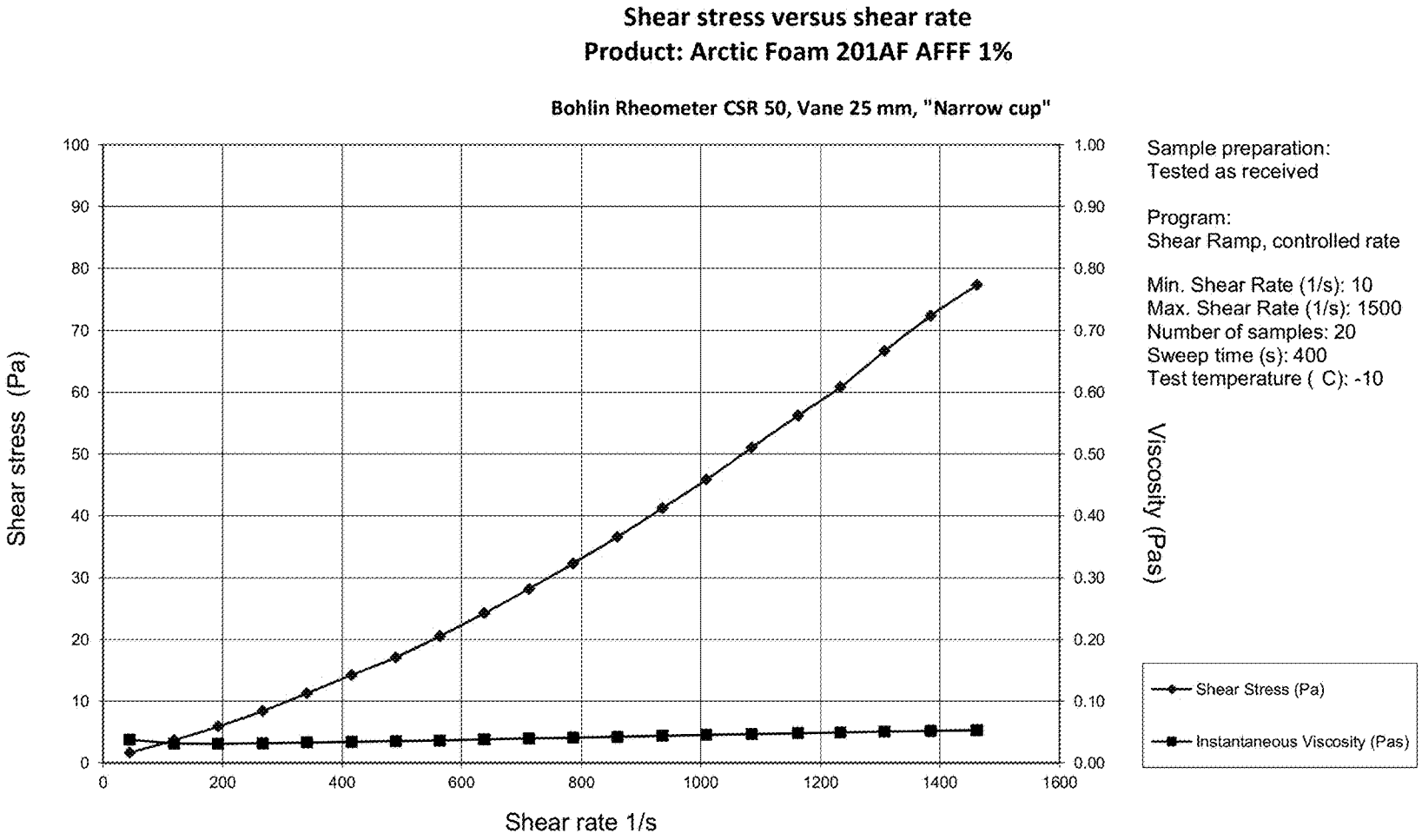
FIG. 1 is a graph of shear rate vs. shear stress for an exemplary concentrated AFFF solution of the invention at −10° C.

The invention provides chemical compositions that can be aerated to form an expanded foam composition (also referred to as a "foam"). The foam can be used in various applications including any applications understood to be useful in the art of aqueous foam materials. The foam finds particular utility in fighting Class B fires including flammable or combustible liquid or gas. The foam can also be useful to contain or suppress volatile, noxious, explosive, flammable, or otherwise dangerous chemical vapors. The vapors may evolve from a chemical such as a chemical storage tank, a liquid or solid chemical, or a chemical spill. The foam can also be used to extinguish a chemical fire or to prevent ignition or re-ignition of a chemical. These applications will be referred to collectively for purposed of the present description as "application to a chemical" or application to a "liquid chemical". The compositions are especially useful for extinguishing and securing extremely flammable (e.g., having low boiling point and high vapor pressure) and difficult-to-secure chemicals, for example transportation fuels such as methyl t-butyl ether (MTBE) and ether/gasoline blends. Additionally, the foam can be applied to other substrates that are not necessarily hazardous, volatile, ignited, or ignitable. As an example, the foam may be applied to land, buildings, or other physical or real property in the potential path of a fire, as a fire break, e.g., to prevent or at least delay such property from catching fire.

The foam is particularly useful in applications at remote or hard to reach locations, such as deep sea oil platforms or refineries. As will be discussed in greater detail below, the foam is produced in a superconcentrated form which saves space and allows for the storage of a greater amount of foam in a smaller area.

As used herein, the term "foam" is used according to its industry-accepted sense, to mean a foam made by physically mixing a gaseous phase (e.g., air) into an aqueous liquid to form a two phase system of a discontinuous gas phase and a continuous aqueous phase.

The foam mix of the invention comprises a concentrated mixture of a saccharide composition, a cross-linking composition or an organic salt, a surfactant and water, as taught for example in U.S. Pat. No. 7,569,155 and U.S. patent application Ser. No. 11/885,495, the disclosures of which are incorporated herein in their entireties by reference.

Saccharides for use in the present invention are generally simple sugars or other such carbohydrates, preferably common sugar (sucrose) derived from sugar cane or sugar beets. Sucrose is a disaccharide composed from the basic, simple sugar molecules glucose and fructose. Sucrose is readily available given that the world production from cane and sugar beet is in the order of millions of tonnes per annum. Those skilled in the art will also be aware that other commercially available simple saccharides and sugars can be utilised in the foaming compositions of the invention.

The carbonised saccharides include caramelised, charred or burnt sugars such as treacle, golden syrup and molasses. In this regard reference to the term "carbonised" as it refers to sugars and saccharides is taken in its broadest sense to include caramelised sugars including those that are sublimed, partially sublimed, flaked, baked, heat-treated or chemically treated to effect a morphological and/or chemical change to the sugar normally resulting in a form of polymerisation of the sugar molecules with concomitant darkening or charring of the sugar.

The carbonised saccharide composition typically contains partially refined saccharide components of, for example, cane sugar present as brown or dark brown sugar, which enhances performance and consistency of performance over mixtures without caramelised, charred or burnt components.

Controlled heating of a raw extract of saccharides a little above its melting point caramelises (or carbonises) the sugar molecules with a loss of water to form yellow, brown or dark brown-coloured sugar products such as molasses. As known in the art, caramelisation of sugars can be achieved by the action of steam pressure on sugar in a caramelising kettle, at a set temperature and for a controlled duration. Usually a heating interval of 60-180 minutes at a temperature of approximately 160-180.degree. C. will give satisfactory results. Typically gentler heating will produce a yellow or brown caramelised sugar, whereas stronger and/or prolonged heating will form darker brown or even black sugars more generally referred to as carbonised sugars.

As used herein, the term "caramelised sugar" is taken to mean any darkened process sugar which includes the lighter caramelised sugars. The addition of carbonised sugar to common white sugar, with the optional addition of invert sugar, produces processed sugar commonly known as brown sugar. In a preferred embodiment, the carbonised saccharide composition for use in the foam forming compositions of the present invention is a brown sugar which has been subjected to a heating or drying step in the manufacturing process.

Alternatively brown sugar is prepared by heating purified sugar syrup until it crystallises to form a soft yellow or brown sugar. The amount and duration of heating has a direct effect on the strength and darkness of the resultant brown sugar.

Dark brown sugar, as supplied by CSR Australia, is particularly suitable for use in the compositions and methods of this invention. The CSR brown sugar comprises sucrose crystals painted with molasses syrup. The proportions are about >85% cane sugar (sucrose and reduced sugars such as glucose/fructose), <15% molasses, and <10% ash (carbonised sugars) and moisture, plus other organics including dextrin and other sugar cane related materials. In the production of the brown sugar, the carbonised saccharide mixture is subjected to a heating or drying step. It is thought that this processing step improves the fire resistance properties of the aqueous foaming compositions of the invention.

Carbonisation of sugars is also possible by treating the sugar with a mineral acid such as sulphuric acid which chars the sugar, formic acid, carbon dioxide and sulphur dioxide being evolved, and a blackened mass of carbon resulting.

A particularly preferred carbonised sugar blend is standard brown sugar obtained from CSR Australia. Best results are obtained from carbonised sugar compositions comprising 86-99.7 wt. % sucrose, 0-7 wt. % reduced sugars (eg., fructose and glucose), with molasses and charred/burnt sugars and ash 0.01-10 wt. % as balance. The quantity of water may be in the range of 5-89.9 wt. %, more preferably 45-70 wt. %; the surfactant 3-33 wt. % and the thickener 0-10 wt. %.

Surfactants are included in the foaming compositions to facilitate foam formation upon aeration, to promote spreading of drainage from the foam composition as a vapor-sealing aqueous foam over a liquid chemical, and, where desired, to provide compatibility of the surfactant with sea water. Useful surfactants include water-soluble hydrocarbon surfactants and silicone surfactants, and may be non-ionic, anionic, cationic or amphoteric. Particularly useful surfactants include hydrocarbon surfactants which are anionic, amphoteric or cationic, e.g., anionic surfactants preferably having a carbon chain length containing from about 6 to about 12 or up to 20 carbon atoms. Salt surfactants, such as for example magnesium acetate, act as a cross linker and also offer protection against freezing. Saccharide surfactants, such as the non-ionic alkyl polyglycosides, can also be useful to the composition. Saccharide surfactants act to promote blending of the saccharides with the foam bubble.

Organic solvents can be included in the foaming composition to promote solubility of a surfactant, to improve shelf life of a concentrated adaptation of the foaming composition, to stabilise the foam, and in some cases to provide freeze protection. Organic solvents useful in the foaming composition include but are not limited to glycols and glycol ethers including diethylene glycol n-butyl ether, dipropylene glycol n-propyl ether, hexylene glycol, ethylene glycol, dipropylene glycol monobutyl ether, dipropylene glycol monomethyl ether, dipropylene glycol monopropyl ether, propylene glycol, glycerol, polyethylene glycol (PEG) and sorbitol.

Thickening agents are well known in the chemical and polymer arts, and include, inter alia, polyacrylamides, cellulosic resins and functionalised cellulosic resins, polyacrylic acids, polyethylene oxides and the like. One class of thickener that can be preferred for use in the foaming composition and methods of the invention is the class of water-soluble, polyhydroxy polymers, especially polysaccharides. The class of polysaccharides includes a number of water-soluble, organic polymers that can increase the thickness, viscosity or stability of a foam composition. Preferred polysaccharide thickeners include polysaccharides having at least 100 saccharide units or a number average molecular weight of at least 18,000. Specific examples of such preferred polysaccharides include xanthan gum, scleroglucan, heteropolysaccharide-7, locust bean gum, partially-hydrolyzed starch, guar gum and derivatives thereof. Examples of useful polysaccharides are described, for example, in U.S. Pat. Nos. 4,060,489 and 4,149,599. These thickening agents generally exist in the form of water-soluble solids, e.g., powders. While they are soluble in water, in their powder form they can and typically do contain a small amount of adventitious or innate water, which is absorbed or otherwise associated with the polysaccharide.

In one embodiment, the foam concentrate composition of the present invention also may comprise a polysaccharide, preferably an anionic heteropolysaccharide having a high molecular weight. The polysaccharide is utilized to stabilize the foam. At rest, these long chained polysaccharide molecules are entwined and thus produce a high viscosity foam solution. During movement, such as the application of shear stress, the polysaccharide molecules elongate and the viscosity of the solution decreases. The resulting foam is thus characterized as pseudoplastic fluid, defined herein as a solution which displays lower viscosity at a higher shear rate. Pseudoplastic foam compositions present unique problems during dilution with water because of the decrease in viscosity observed with the application of shear stress during mixing. Special equipment is needed in most cases to mix the foam concentrate. As a result, creation of a more concentrated pseudoplastic foam solution is not practical.

Many prior art foam concentrates utilize a polysaccharide concentration of varying amounts. The resulting mix requires a dilution at, for example, 3% or 6% (e.g., 3% foam concentrate with 97% water). The inventors of the currently disclosed invention have unexpectedly found that a foam mix with a lowered polysaccharide concentration, for example less than 0.1%, produces a solution with improved viscosity characteristics. A mix with this concentration of polysaccharides is classified as a Newtonian solution, defined herein as a foam concentrate that displays constant viscosity at various shear rates. The decrease in polysaccharide concentration in the current invention produces a mix with lower viscosity when subjected to mixing forces, allowing the solution to be more easily diluted in water. The present foam mix requires dilution at, for example, at less than 1.3% concentrate (e.g., less 1.3% foam solution with more than 98.7% water). As a result, the current foam composition may be stored as a more concentrated solution, thus requiring less storage space and lowering operational expenses. In another embodiment, the foam concentration of the present invention contains no polysaccharides. In another embodiment, the foam mix requires dilution 0.9% to 1.3% concentrate.

Commercially available polysaccharides useful in the invention include those sold under the trademarks, e.g., Kelzan™ and Keltrol™ (available from Kelco). The polymeric structure is not critical for the purposes of this invention. Only a small amount of polysaccharide is required to result in a noticeable change in properties.

Optionally, other polymeric stabilizers and thickeners can be incorporated into the concentrate compositions of the invention to enhance the foam stability of the foam produced by aeration of the aqueous solution made from the concentrate. Examples of suitable polymeric stabilisers and thickeners are partially hydrolzyed protein, starches and modified starches, polyacrylic acid and its salts and complexes, polyethyleneimine and its salts and complexes, polyvinyl resins, e.g., polyvinyl alcohol, polyacrylamides, carboxyvinyl polymers and poly(oxyethylene)glycol.

Other ingredients known to those skilled in the art that are usually employed in fire-fighting compositions may be employed in the concentrate compositions of this invention. Examples of such ingredients are preservatives, buffers to regulate pH (e.g., tris(2-hydroxyethyl)amine or sodium acetate), corrosion inhibitors (e.g., toluoltriazole or sodium nitrite), antimicrobial agents, divalent ion salts, foam stabilisers and humectants. In addition, flame retardant materials such as inorganic salts (ex phosphates or sulfates) and organic salts (such as salts of acetate).

A foaming composition can be prepared by mixing or combining together its ingredients, e.g., water, a carbonised saccharide mixture, and surfactant, plus any additionally desired ingredients. For example, a foaming composition can be prepared by providing water, e.g., a fixed amount within a reaction vessel or other container, or preferably a flow of water travelling through a hose or pipe, most preferably a hose, and then adding non-water ingredients (e.g., surfactant, thickener, etc.) to the water. The non-water ingredients can be added to the water individually or as one or more mixtures, and in any desired order.

A foaming composition can be prepared using foam production equipment known in the fire-fighting art. Such equipment can include a conventional hose to carry a flow of water, plus appurtenant equipment useful to inject, educt or otherwise add non-water ingredients to the flow of water. Water can flow under pressure through a fire hose, and surfactant, thickener, and other non-water ingredients can be injected or drawn (e.g., educed by venturi effect) into the flow of water. Other techniques such as compressed gas foaming systems can be employed as well known to those skilled in the art.

The composition of the invention is employed in the usual way to combat fires of flammable liquids or to prevent evaporation of flammable vapours. The composition is particularly suitable for application in the form of a foam. Usually it is stored in the form of an aqueous concentrate only requiring dilution typically as a 1.3% or less concentrate with either fresh, brackish or sea water to form the "premix", followed by aeration of the premix to produce a foam which is applied to the burning substrate or substrate to be protected as required. The use of carbonised saccharide mixtures provides better fire protective properties of the foams of the invention when sea water, or brackish water, is used as the diluent.

The foam mixture of the invention is a capable Class A foam that due to the surfactant mixture is capable of wetting fuels such as wood, paper, rubber, fabric, etc., and provide higher retained moisture to prevent combustion. Without wishing to be limited to theory, it is believed that the inclusion of sugars, and charred or burnt sugars, and related molasses and partially refined components of sugar cane, will form a protective layer and char further when fire impinges on the coated material. In a fire situation, the foam mixture can extinguish the fire via cooling and smothering (oxygen removal). The related sugar compounds could again form a protective layer on the combustible fuel if applied at significant concentrations.

The foam of the invention has rapid flow characteristics on flammable liquids, like an aqueous film forming foam (AFFF), yet does not necessarily fulfill the mathematical parameters of the spreading coefficient calculation, nor does it necessarily have a positive spreading coefficient. However the mixtures do have measurable and well-defined surface tensions and interfacial tensions.

Other uses, embodiments and advantages of this invention are further illustrated by the following examples, but the particular materials and amounts thereof cited in these examples, as well as other conditions and details, should not be construed to unduly limit this invention.

EXAMPLES

Example 1

Figure 2:
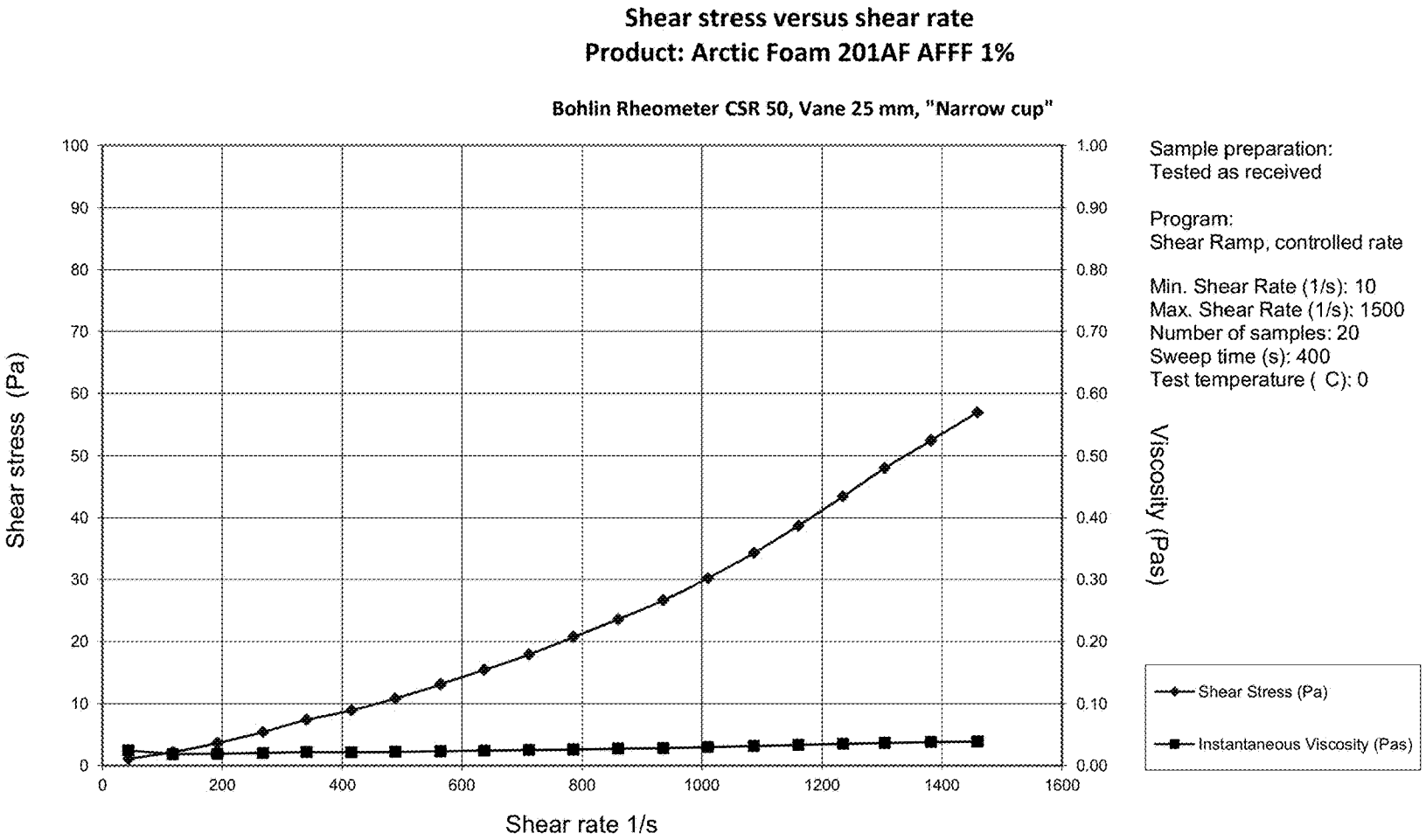
FIG. 2 is a graph of shear rate vs. shear stress for the AFFF solution of FIG. 1 at 0° C.
Figure 3:
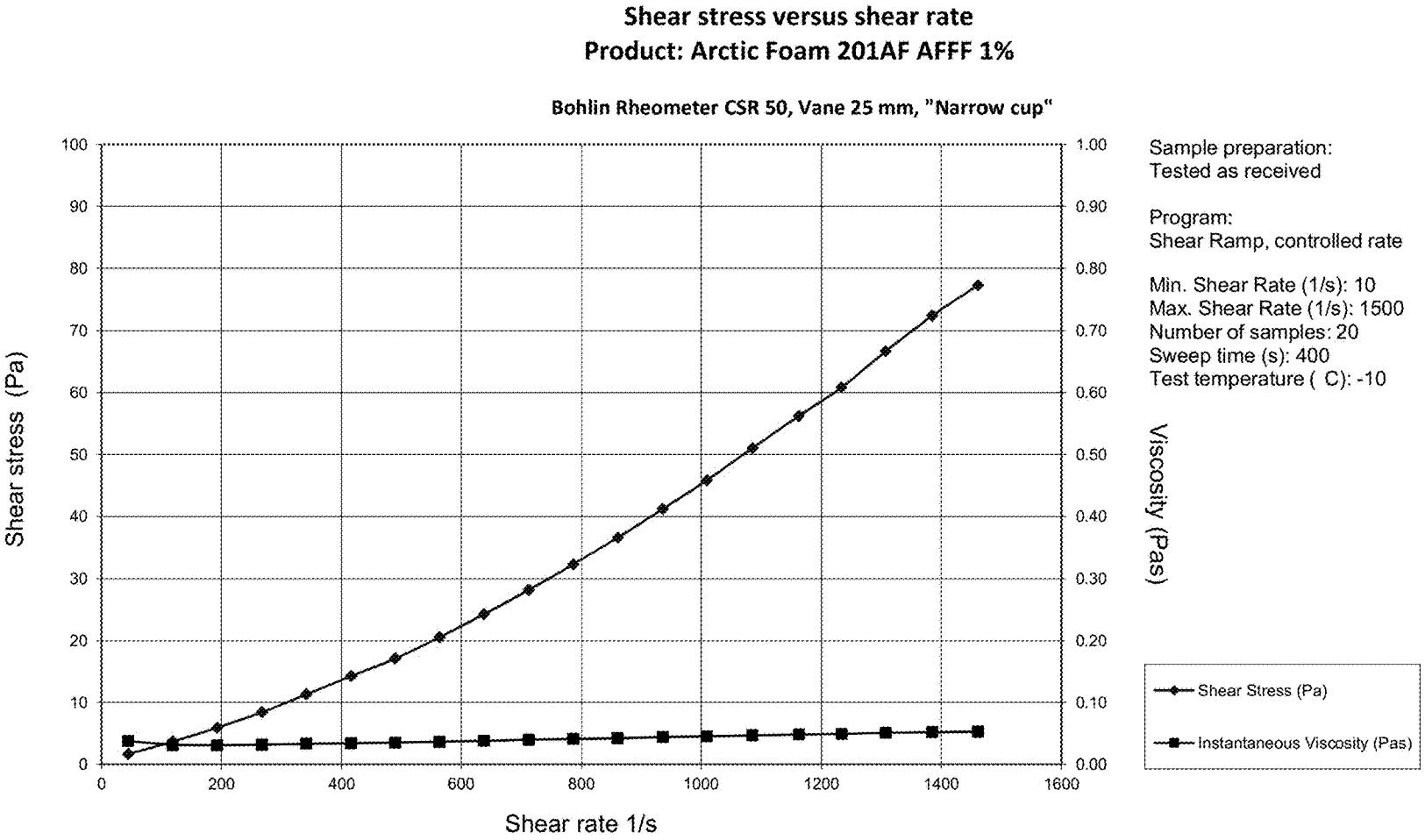
FIG. 3 is a graph of shear rate vs. shear stress for the AFFF solution of FIG. 1 at −10° C.

For comparison purposes, FIGS. 1 through 3 illustrate the results of shear rate and shear stress testing on a 1% concentrated AFFF foam mix marketed under the name ARCTIC FOAM by Solberg Scandinavia AS. In general, the Newtonian solution has a viscosity of approximately 37 cst at room temperature. The results illustrated in FIGS. 1 through 3 indicate a shear stress of <200 mPa·s at 375-1 shear rate, a viscosity indicative of a Newtonian material.

Example 2

Figure 4:
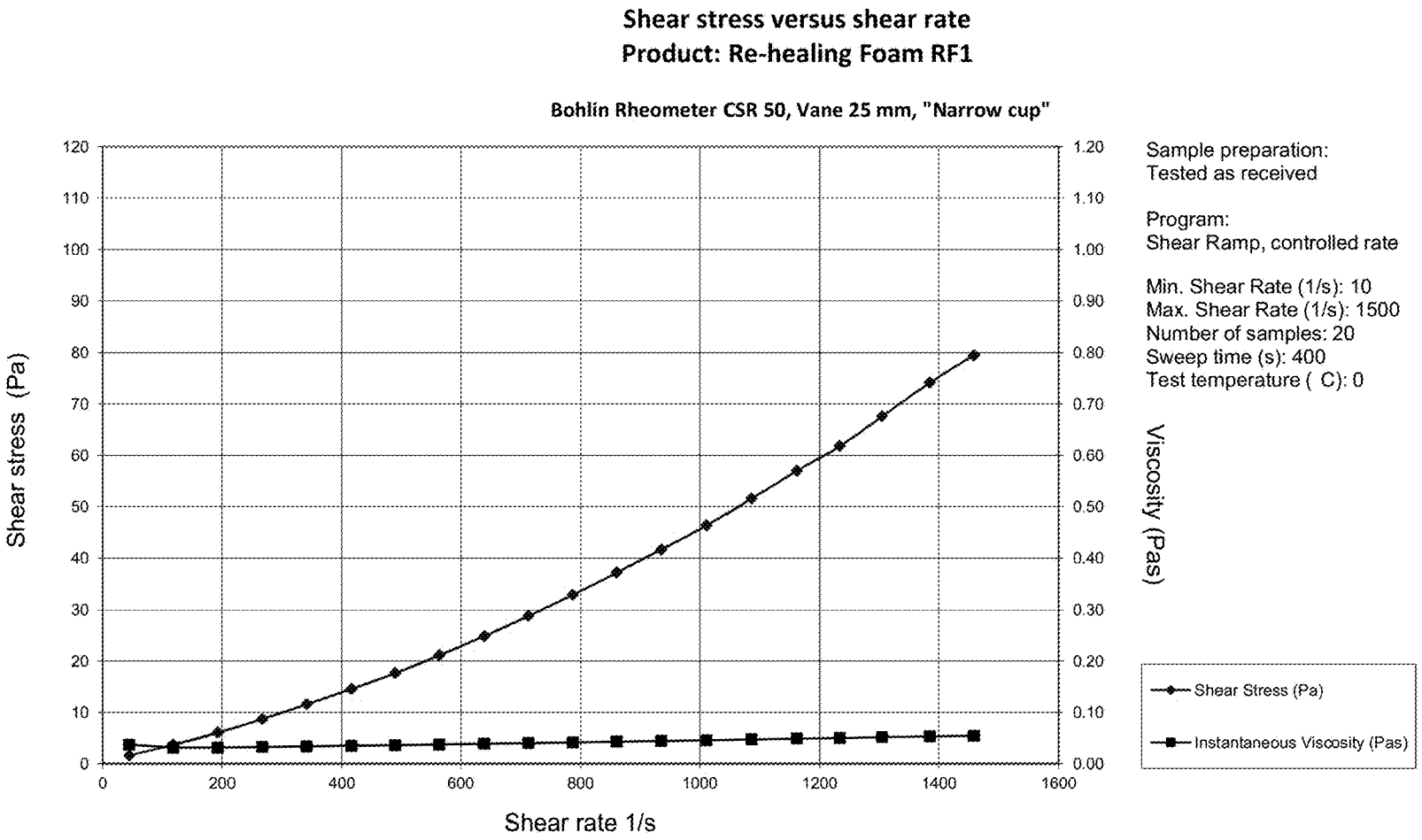
FIG. 4 is a graph of shear rate vs. shear stress for an exemplary concentrated foam solution of the invention at 0° C.
Figure 5:
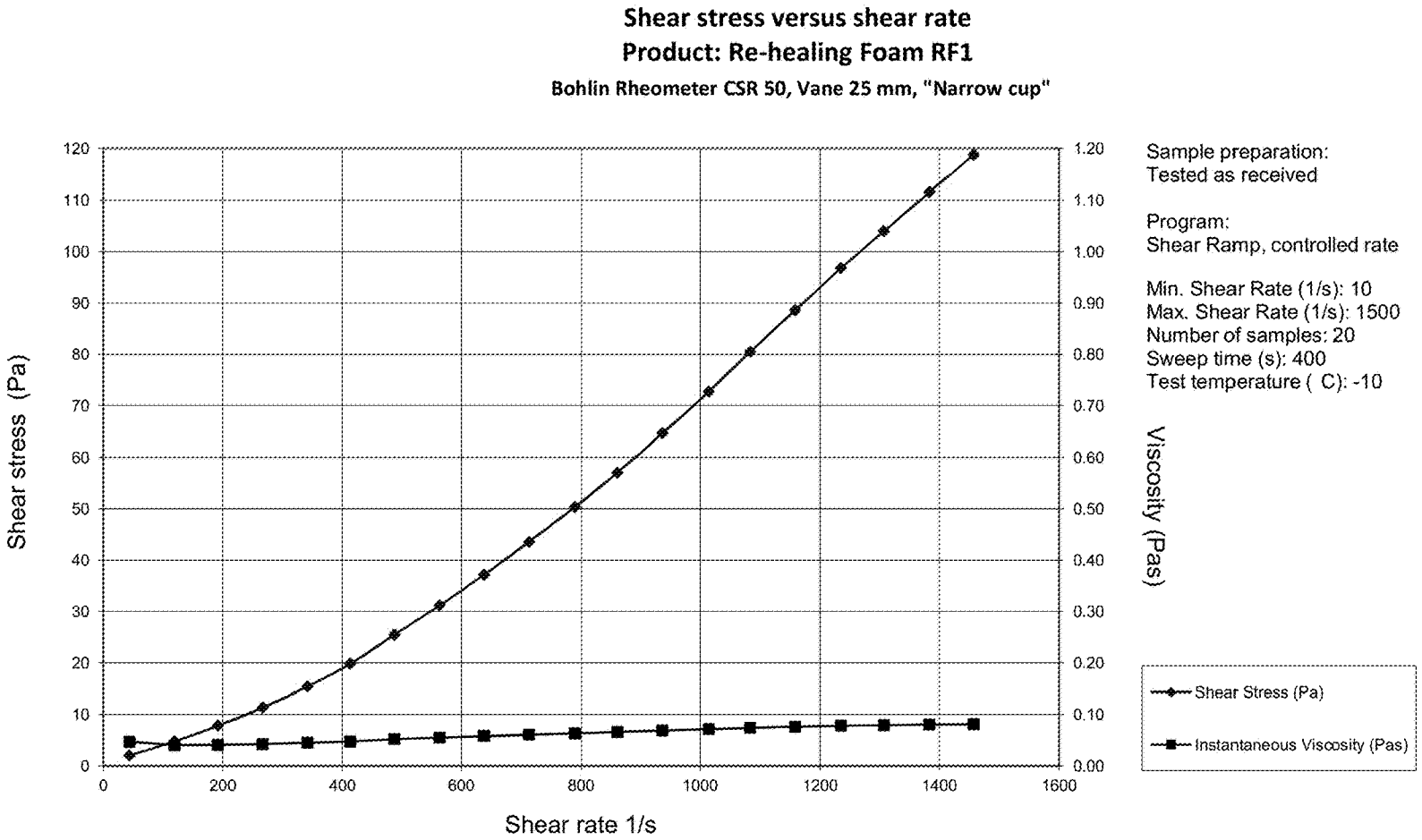
FIG. 5 is a graph of shear rate vs. shear stress for the solution of FIG. 4 at −10° C.
Figure 6:
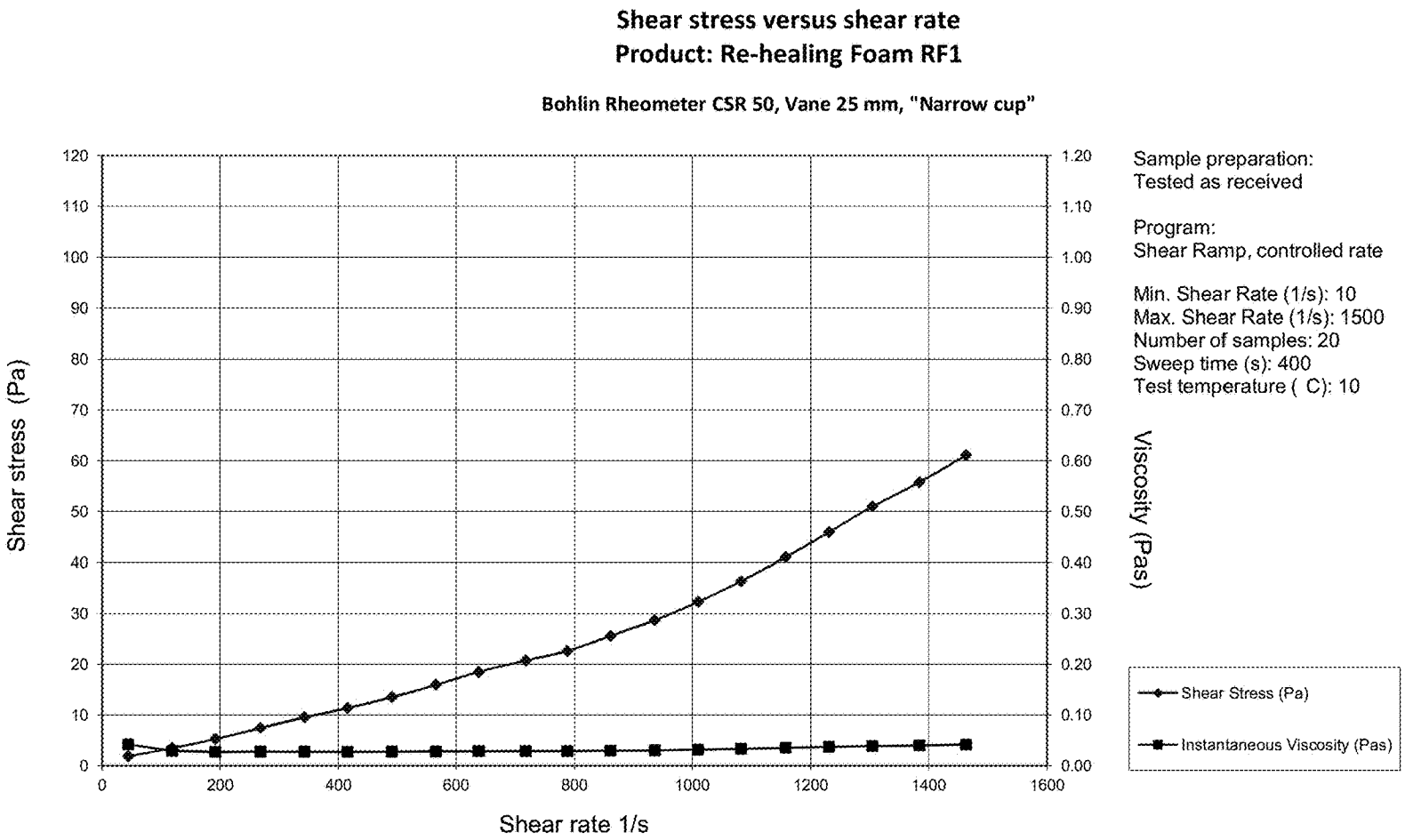
FIG. 6 is a graph of shear rate vs. shear stress for the solution of FIG. 4 at 10° C.

FIGS. 4 through 6 illustrate the results of a shear rate and shear stress testing on a 1% concentrated foam mix in accordance with the present invention. The foam mixture includes a polysaccharide content of between 0 and less than 0.25% by weight. A typical formulation is provided in Table 1 following general mixture suitable for use at 0.9% to 1.3% volume concentration (with 99% volume water). The raw materials are mixed together in any suitable order and way as known to those skilled in the art. The formula mix may be pH adjusted such as to neutral if required. This mixture is suitable for dilution and foamed expansion for application to flammable liquid fires. Persons skilled in the art may alter the proportions as appropriate to make concentrations other than 1 wt. %, such as for example 0.1 wt. % as desired.

TABLE 1

| Class | Chemical Name | Amount (% by Weight) | Ranges (% by Weight) |
|---|---|---|---|
| Foam Stabilizer | Polycarboxylic acid | 2.0 | 0.1 to 2.00 |
| Nonionic Surfactant | Alkyl Polyglucoside | 1.5 | 1.2 to 6.0 |
| Anionic/Biocide | Monolaurin | 0.5 | 0.5 to 2.0 |
| Nonionic Surfactant | Sodium Decylgmcosides Hydroxypropyl Phosphate | 1.5 | 0.2 to 2.0 |
| Nonionic Surfactant | Sodium Laurylglucosides Hydroxypropylsulfonate | 1.5 | 0.1 to 5.0 |
| Nonionic Surfactant | Polmeric Alkyl Polyglucoside anionic surfactant | 1.5 | 0.1 to 2.0 |
| Anionic Surfactant | Triethanolamine Alkyl Sulphate | 7.0 | 0.0 to 10.0 |
| Anionic Surfactant | Sodium-n-Octylsulfate | 9.0 | 0.0 to 15.0 |
| Anionic Surfactant | Sodium-n-Decylsulfate | 2.0 | 0.0 to 5.0 |
| Anionic Surfactant | Sodium Alkyl Ethoxy Sulphate | 6.0 | 0.0 to 10.0 |
| Amphoteric Surfactant | Cocamidopropyl Hydroxysutaine | 7.14 | 2.0 to 8.0 |
| Amphoteric Surfactant | Cocoamido Propyl Betaine | 5.63 | 1.5 to 7.0 |
| Amphoteric Surfactant | Cocamidopropylamine Oxide | 0.75 | 0.2 to 0.8 |
| Silicone Surfactant | Coco Glucosides Hydroxylpropyl Dimethicone Copolymer | 1.5 | 0.0 to 2.0 |
| Sucrose/Molasses | Dark Brown Sugar | 8.0 | 5.0 to 15.0 |
| Sucrose | Short Chain Sugar | 7.0 | 0.0 to 10.0 |
| Dextrose | White Sugar | 2.0 | 1.0 to 10.0 |
| Salt | Magnesium Acetate | 7.0 | 6.0 to 20.0 |
| Solvent | Butyl Carbitol | 5.0 | 0.0 to 15.0 |
| Buffer | Triethanolamine | 0.5 | 0.0 to 5.0 |
| | Water | 22.98 | |
| | Total | 100 | |
| | Total Active Surfactant | 18.75 | |
| | Amphoteric Surfactant | 5.48 | |
| | Anionic Surfactant | 9.62 | |
| | Nonionic Surfactant | 2.8 | |
| | Sugar | 17.0 | |

Nonionic surfactants may be selected from Agnique® series surfactants from BASF, ALKADET® series and ECOTERIC® series surfactants from Hunstman Surfactant Technology, and SugaFax, Poly SugaPhos and Suganate series surfactants from Colonial Chemical, Inc. Anionic surfactants may be selected from Texapon® series surfactants from BASF and Tensagex series surfactants from Tensa-Chem, SA. Amphoteric surfactants may be selected from GARDIQUAT series surfactants from Albright & Wilson and Dehyton® series surfactant from BASF.

The results illustrated in FIGS. 3 through 6 show a viscosity indicative of a Newtonian material.

Performance testing of the foam mixture showed that the mixture is effective for fire control, fire extinguishment, and burn back resistance capabilities similar to AFFF technology when used on flammable liquids. This has been observed on a number of flammable liquid fuels and a variety of flammable liquid test pools (of surface area 0.28 m2, 3.0 m2, 4.5 M2, and 90 m2). Tests were conducted on flammable liquids such as AVGAS, AVTUR, and naphthalated blends. The 90 m2 surface area test does not represent a standard test, but represents an application density of between 2.5-5.0 ltm/m2 on larger fires as per the recommendations of Underwriters Laboratories.

Example 3

Figure 7:
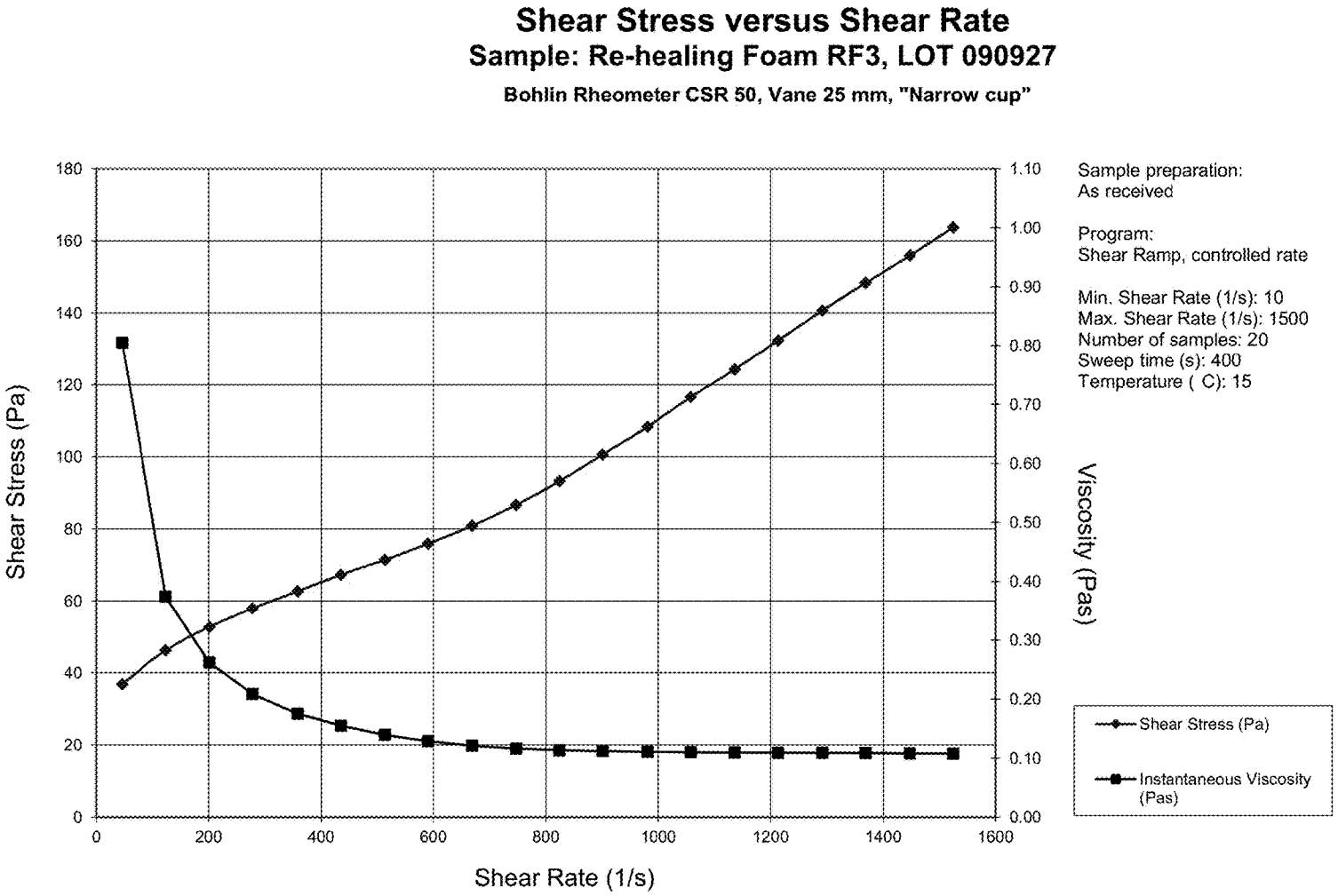
FIG. 7 is a graph of shear rate vs. shear stress for an additional exemplary concentrated foam solution of the invention at 15° C.
Figure 8:
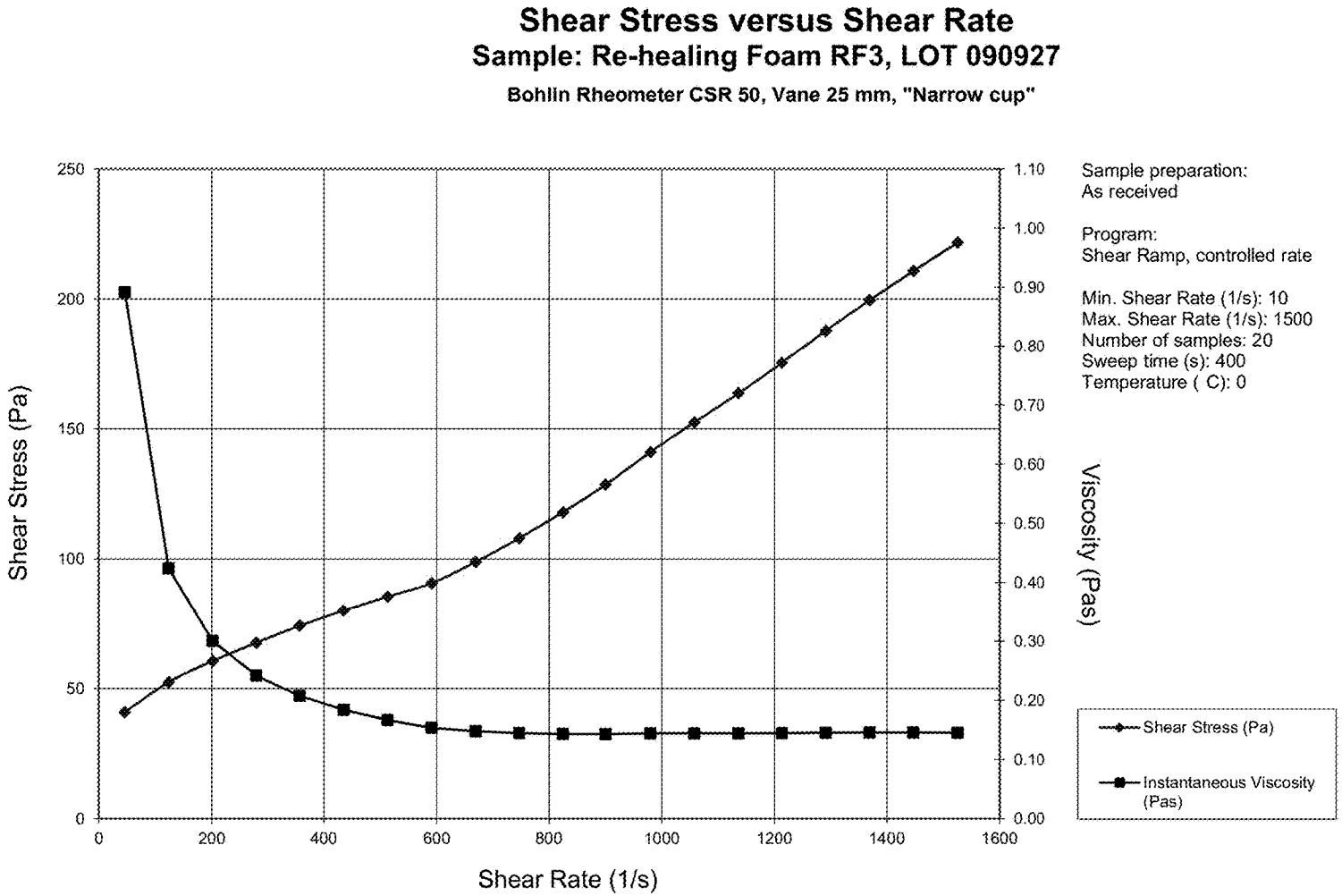
FIG. 8 is a graph of shear rate vs. shear stress for the additional exemplary concentrated foam solution of FIG. 7 at 0° C.

FIGS. 7 and 8 illustrate the results of a shear rate and shear stress testing on a 1% concentrated foam mix in accordance with the present invention; however, this foam mixture includes a polysaccharide content of between 0.25% and 1.2% by weight. A typical formulation is provided in Table 1 following general mixture suitable for use at 0.9% to 1.3% volume concentration (with 99% volume water). The results illustrated in FIGS. 7 through 8 show a viscosity indicative of a pseudoplastic material which results from a higher polysaccharide content as compared to the mixture of Example 2. A polysaccharide content greater than 1.2% in a mixture of the present invention result in a product too thick to function as a fire fighting foam.

The invention claimed is:

1. A method of making a fire extinguishing foam solution comprising:

providing a fluorine-free concentrate including a sugar that has been subjected to a carbonization step during its manufacture and one or more surfactants, wherein the concentrate is free of fluorine, and forming a foam forming solution by diluting the concentrate with water, wherein the foam forming solution contains less than 1.3% by volume of the concentrate and exhibits a viscosity of 100 cSt or less.

2. The method according to claim 1 wherein the concentrate includes a cross-linker.

3. The method according to claim 1 wherein the water is sea water.

4. The method according to claim 1 wherein the sugar is a dark brown sugar.

5. The method according to claim 1 wherein the concentrate includes less than 34% by weight of water.

6. The method according to claim 1 wherein the concentrate includes one or more polysaccharides.

7. The method according to claim 6 wherein the one or more polysaccharides are present in the concentrate at an amount equal to or less than 0.1% by weight.

8. The method according to claim 1 wherein the foam forming solution is a Newtonian solution.

9. The method according to claim 1 further comprising aerating the foam forming solution thereby forming a foam.

10. The method according to claim 9 further comprising applying the foam to a Class B fire and effectively extinguishing the fire.

11. The method according to claim 1 wherein the concentrate is free of persistent organic pollutants.

12. A fire extinguishing foam solution comprising:

a concentrate including a sugar that has been subjected to a carbonization step during its manufacture, an amount of water added to the concentrate to provide a mix including 1.3% by volume or less of the concentrate, and one or more surfactants, wherein the concentrate is free of fluorine and persistent organic pollutants and the mix exhibits a viscosity of 100 cSt or less.

13. The solution according to claim 12 wherein the concentrate includes between 10% by weight and 35% by weight of the water.

14. The solution according to claim 12 wherein the concentrate includes 6% to 17% by weight of the sugar.

15. The solution according to claim 12 wherein the concentrate includes about 19% by weight of the one or more surfactants.

16. The solution according to claim 12 wherein the concentrate includes a total polysaccharide content of 0.1% by weight or less.

17. The solution according to claim 12 wherein the mix is a Newtonian solution.

18. The solution according to claim 12 wherein the mix is in the form of a foam.

19. The solution according to claim 12 further comprising 15% to 20.0% by weight of total active surfactant.

20. The solution according to claim 12 further comprising 4.5% to 7.0% by weight of amphoteric surfactant.

21. The solution according to claim 12 further comprising 7.0% to 11.0% by weight of anionic surfactant.

22. The solution according to claim 12 further comprising 1.0% to 4.0% by weight of nonionic surfactant.

23. The solution according to claim 12 further comprising 0.1% to 2.0% by weight of a stabilizer.

24. The solution according to claim 12 further comprising 6.0% to 20.0% by weight of salt.

25. The solution according to claim 12 further comprising 0.1% to 15.0% by weight of solvent.

26. A method of extinguishing a fire comprising:

providing a concentrate including a sugar that has been subjected to a carbonization step during its manufacture, and one or more surfactants, wherein the concentrate is free of fluorine, mixing the concentrate with an amount of water to provide a solution including 1.3% or less by volume of the concentrate, aerating the solution to produce a foam, and applying the foam to a fire, wherein the foam is not an aqueous film forming foam or an alcohol-resistant aqueous film forming foam.

27. The method according to claim 26 wherein the concentrate includes between 10% by weight and 35% by weight of the water.

28. The method according to claim 26 wherein the concentrate includes about 17% by weight of the sugar.

29. The method according to claim 26 wherein the concentrate includes about 19% by weight of the one or more surfactants.

30. The method according to claim 26 wherein the concentrate includes a total polysaccharide content of 0.1% by weight or less.

31. The method according to claim 26 wherein the concentrate is free of persistent organic pollutants.

32. The method according to claim 26 wherein the foam forming solution is a Newtonian solution.

33. The method according to claim 26 wherein the fire is a Class B fire.

34. The method according to claim 26 wherein the solution includes 1.0% or less by weight of the concentrate.

35. The method according to claim 26 wherein the concentrate meets or exceeds European Standard EN 1568-3 for low expansion fire extinguishing foam concentrates.

36. The method according to claim 26 wherein the concentrate meets or exceeds Underwriters Laboratories standard for safety for foam equipment and liquid concentrates UL 162.

37. The method according to claim 26 comprising mixing the concentrate with an amount of water to provide a solution including between 0.9% to 1.0% by volume of the concentrate.

38. The method according to claim 26 comprising applying the foam directly to the fire using a sprinkler system.

39. A method of extinguishing a fire comprising:

providing a concentrate including a sugar that has been subjected to a carbonization step during its manufacture, and one or more surfactants, wherein the concentrate is free of fluorine, mixing the concentrate with an amount of water to provide a solution including 1.3% or less by volume of the concentrate, aerating the solution to produce a foam, and applying the foam to a fire, wherein the solution exhibits a viscosity of 100 cSt or less.

* * * * *